US005610004A

United States Patent [19]

Tanaka

[11] Patent Number: 5,610,004

[45] Date of Patent: Mar. 11, 1997

[54] METHOD OF MANUFACTURING SILVER HALIDE PHOTOGRAPHIC EMULSIONS

[75] Inventor: Shigeo Tanaka, Hino, Japan

[73] Assignee: Konica Corporation, Japan

[21] Appl. No.: 576,500

[22] Filed: Dec. 21, 1995

[30] Foreign Application Priority Data

Dec. 26, 1994 [JP] Japan ..... 6-321111

[51] Int. Cl.[6] ..... G03C 1/09; G03C 1/035

[52] U.S. Cl. ..... 430/569; 430/603

[58] Field of Search ..... 430/603, 569

[56] References Cited

U.S. PATENT DOCUMENTS 3,503,749 3/1970 Tavernier et al. ..... 430/603
4,863,843 9/1989 Okushima et al. ..... 430/603
4,892,804 1/1990 Vincent et al. ..... 430/380
5,028,522 7/1991 Kojima et al. ..... 430/603

FOREIGN PATENT DOCUMENTS 6230494 8/1994 Japan ..... 430/603

*Primary Examiner*—Mark F. Huff
*Attorney, Agent, or Firm*—Jordan B. Bierman; Bierman and Muserlian

[57] ABSTRACT

A step manufacturing method of a silver halide photographic emulsion comprising silver halide grains having a silver chloride content of not less than 95 mol % is disclosed, the method comprising the steps of mixing a silver salt and a halide to form a silver halide emulsion and chemically ripening the resulting silver halide emulsion, wherein a compound having two or more sulfonic acid or sulfonic acid salt groups in its molecule is added to the silver halide emulsion at the chemical ripening.

8 Claims, No Drawings

METHOD OF MANUFACTURING SILVER HALIDE PHOTOGRAPHIC EMULSIONS

FIELD OF THE INVENTION

The present invention relates to a method of manufacturing a high-speed and stable silver halide photographic emulsion wherein performance varies less from lot to lot in manufacturing and speed variation and increase in fog both with time in an emulsion after chemical ripening are less.

BACKGROUND OF THE INVENTION

With the diffusion of rapid processing in recent years, a huge amount of color photographic light-sensitive materials for printing (hereinafter referred to as simply light-sensitive materials or color papers) are processed rapidly. Rapid processing is a very strong demand in a color photography field, and a great many improvements therefor have been made and new rapid systems have been developed every few years. For realizing the rapid processing, it is necessary to shorten independently each step of the processing, such as a step of color developing, a step of bleach-fixing, a step of washing and a step of drying. As a method of realizing the rapid processing, International Patent Publication No. WO87/04534, for example, discloses a method of processing rapidly using a color photographic light-sensitive material employing a high silver chloride emulsion, and it shows that the use of a high silver chloride photographic emulsion is preferable from the viewpoint of rapid processing. However, it is known that when the rate of containing silver chloride is enhanced, silver chloride photographic emulsion has a disadvantage that its sensitivity is generally low, although the developing speed therefor can be improved remarkably. There have been made various attempts to make a silver halide photographic emulsion having high rate of containing silver chloride to be highly sensitive to overcome the disadvantage mentioned above.

Recently, the number of stores having a minilab of a rapid processing type installed is increased year after year. There has been a growth of business enjoying an advantage of a minilab of a rapid processing type, including an introduction of a minilab for the service to make a customer to have a print without waiting in a pleasure resort, or an introduction of a minilab in a store other than a professional photographic store. Accordingly, an amount of color papers used is increased year by year. With regard to color papers, there are demanded those with stable performance wherein sensitivity and gradation are always constant without any dispersion so that persons other than a photographic specialist can make a print simply under the same condition. In the photographic business field, various studies have been made so that stable color papers can be supplied. It is generally known that storage life of a silver halide emulsion is poor showing that its photographic sensitivity is lowered and fog increases rapidly. For example, Japanese Patent O.P.I. Publication Nos. 323645/1992 and 222523/1994 disclose a technology for stabilizing sensitivity and fog fluctuation in an emulsion solution. The technology, however, is for preventing performance fluctuations with time in a solution for a period of time covering emulsion dissolution through coating, and it has a disadvantage that dispersed performance of an emulsion existing before dissolution of the emulsion remains as it is undesirably. Under the circumstances mentioned above, the inventors of the invention studied, in many ways, technologies for stabilizing performance of an emulsion in the course of manufacture of the emulsion.

U.S. Pat. Nos. 2,463,794, 2,489,341, 2,565,418, 2,614,928, 2,618,556, 2,996,287, 3,241,969, 3,498,454, 4,990,439, and RD. Vol. 102, October, 1972, Item 10208 disclose compounds containing 2-naphthylsulfonic acid. These technologies represent those added as a coagulation/sedimentation agent, in the course of a desalting process for silver halide. However, as a result of various studies of these technologies, the inventors have found that these technologies tend to vary in terms of performance and thereby to cause fluctuation in the performance though they function as a coagulation/sedimentation agent.

Japanese Patent O.P.I. Publication Nos. 181240/1993 and 281649/1993 disclose a technology to add sulfonic acid compounds. However, the sulfonic acid compound of the technology is not added in the course of chemical ripening but is added in a step of preparation for coating, and its object is not an improvement of performance fluctuation of an emulsion.

SUMMARY OF THE INVENTION

An object of the invention is to provide a method of manufacturing a high-speed and stable silver halide photographic emulsion wherein performance varies less from a lot to a lot in manufacturing and sensitivity variation and increase in fog both with time in an emulsion after chemical ripening are less.

DETAILED DESCRIPTION OF THE INVENTION

The above object of the invention could be attained by the following constitutions:

1. a method of manufacturing a silver halide photographic emulsion comprising silver halide grains having a silver chloride content of not less than 95 mol %, the method comprising the step of chemically ripening a silver halide emulsion, wherein a compound having two or more sulfonic acid groups or sulfonic acid salt groups in its molecule is added to the silver halide emulsion at the chemical ripening, 2. the method of manufacturing a silver halide photographic emulsion of 1 above, wherein the compound consists of three or more units having a sulfonic acid group or a sulfonic acid salt group, 3. the method of manufacturing a silver halide photographic emulsion of 1 above, wherein the compound consists of five or more units having a sulfonic acid group or a sulfonic acid salt group, or 4. the method of manufacturing a silver halide photographic emulsion of 1, 2 or 3 above, wherein coefficient of variation of the silver halide grain diameter distribution is not more than 0.20.

Next, the invention will be explained in detail.

It is essential that the compound having two or more sulfonic acid groups or sulfonic acid salt groups in its molecule (hereinafter referred to as the compound in the invention) be added to the silver halide emulsion at the chemical ripening. The chemical ripening referred to herein is a chemical ripening process in which a chemical sensitizer is added to an emulsion after precipitation of silver halide grains and desalting. The compound in the invention may be added before or after the addition of the chemical sensitizer.

The compound in the invention has two or more units having a sulfonic acid group or a sulfonic acid salt group in its molecule, preferably three or more units having a sulfonic acid group or a sulfonic acid salt group in its molecule, and especially preferably five or more units having a sulfonic acid group or a sulfonic acid salt group in its molecule. The salt includes an alkali metal salt, and preferably a sodium salt.

In the invention the compound having two or more sulfonic acid or sulfonic acid salt groups in its molecule is preferably a condensation compound of naphthalene sulfonic acid or naphthalene sulfonic acid salt with formaldehyde or a polymeric compound having a chemical structure represented by the following formula (1):

formula (1)

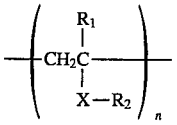

wherein $R_1$ represents a hydrogen atom or an alkyl group; X represents a divalent bonding group, and preferably —OCO—, —CONR'— or —$SO_2$NR'—, in which R' represents a hydrogen atom or an alkyl group; $R_2$ represents a group having a sulfonic acid or sulfonic acid salt group, preferably an alkyl, aryl or aralkyl group each having a sulfonic acid or sulfonic acid salt group; and n represents an integer of 2 or more.

The alkyl group in $R_2$ includes methyl, ethyl or propyl, the aryl group in $R_2$ includes phenyl or naphthyl, and the aralkyl group in $R_2$ includes benzyl. n is preferably an integer of 2 to 20. The polymeric compound may be a copolymer further containing in it a unit derived from acrylic acid, methacrylic acid, an acrylate, a methacrylate, acrylamide or methacrylamide. The condensation compound may be a mixture of condensation products of various polymerization degrees.

The addition amount of the compound in the invention is 0.1g/mol of Ag or more, and preferably 0.1 to 7.0 g/mol of Ag, and more preferably 0.2 to 6.0 g/mol of Ag in view of fog restrain.

The exemplified compounds in the invention will be shown below, but the invention is not limited thereto.

[Z-1]

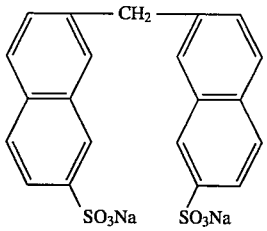

[Z-2]

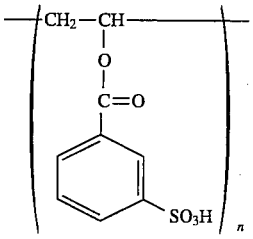

n = 10

-continued

[Z-3]

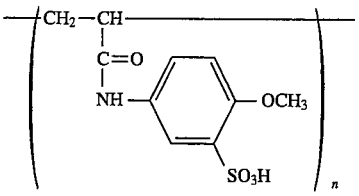

n = 7

[Z-4]

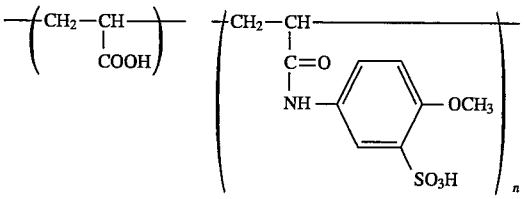

n = 8

[Z-5]

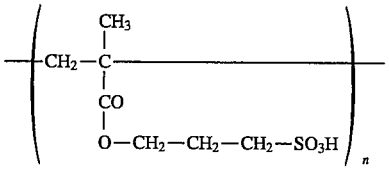

n = 9

[Z-6]

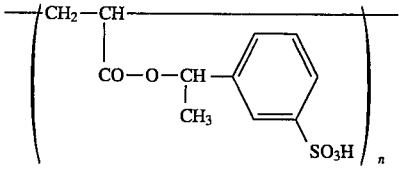

n = 9

[Z-7]

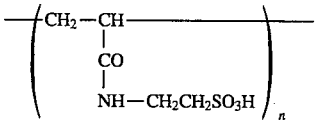

n = 5 a condensate of 2-naphthylsulfonic acid and formalin [Z-8]

n = 8 a condensate of 2-naphthylsulfonic acid and formalin [Z-9]

n = 3

The silver halide grains in the invention are silver bromochloride grains containing substantially no iodide, preferably having a silver chloride content of 95 mol % or more and more preferably a silver chloride content of 98 to 99.9 mol %. The silver bromochloride grains containing substantially no iodide refer to as silver bromochloride grains having a silver iodide content of 2% or less, preferably 1% or less, and most preferably 0%.

The silver halide grains in the invention include grains having a uniform composition, grains having a silver bromide rich layer in the grain surface or grains having a silver bromide rich layer in inner portions of the grain. Further, the grains in the invention may be a mixture of silver halide grains different in composition.

There is no limitation to the grain size of silver halide grains. However, considering properties for rapid processing, sensitivity and other phoographic properties, the preferred size is 0.25 to 1.2 μm. Incidentally, the above-mentioned grains can be measured by the use of various methods commonly used in this field. The typical ones are described in "Analysis Method for Grain Size" Loveland (A.S.T.M. Symposium on Light Microscopy, 1955, pp 94 to 122) or the second chapter of "The Theory of Photographic Process" (written by Meeth and James, 3rd edition, published by MacMillan Inc. (1966)).

The grain distribution of silver halide grains may be poly-dispersed or mono-dispersed. The silver halide grains is mono-dispersed silver halide grains having a coefficient of variation of the silver halide grain distribution of preferably not more than 0.20, and more preferably not more than 0.15. Here, "coefficient of variation" is a coefficient showing the width of grain distribution, which is defined as follows:

Coefficient of variation=S/R (wherein S represent a standard deviation of grain distribution; and R represents an average grain size.)

The "grain size" referred to here is defined to be, in the case of spherical silver halide grains", a diameter thereof and, in the case of grains cubic or other than spherical, a diameter thereof when the projected image is converted to the circle having the same area.

As an apparatus and a method for preparing silver halide emulsions, various conventional ones known in the art can be used.

The silver halide emulsions of the present invention may be prepared through any of those including an acid process, a neutral process and an ammonia process. Aforesaid grains may be grown directly, or may be grown after producing seed grains. A method for producing seed grains and a method for growing them may be the same or different. In addition, as a method to cause soluble silver salt and a soluble halogenated salt to react, any of a normal precipitation method, a reverse precipitation method, a double-jet method and combination thereof are allowed. Of them, those obtained through a double-jet method is desirable. In addition, as one type of a double-jet method, pAg-controlled double jet method described in Japanese Patent OPI Publication No. 48521/1979 can also be used. In addition, an apparatus disclosed in Japanese Patent O.P.I. Publication Nos. 92523/1982 and 92524/1982 wherein water-soluble silver salt and water-soluble halogenated compound salt aqueous solution is fed from an addition device placed in an initial solution for reaction or an apparatus disclosed in German Patent No. 2921164 wherein the concentration of water-soluble silver salt and water-soluble halogenated compound salt aqueous solution is continuously changed for adding may be used.

In addition, if necessary, silver halide solvents such as thioether may be used. In addition, compounds having a mercapto group and compounds such as nitrogen-containing heterocycles or sensitizing dyes may be used by adding during formation of silver halide grains or after completion of forming grains.

As a desalting method there are a ultra filtration method disclosed in Japanese Patent Publication No. 501776/1981 and U.S. Pat. No. 4,334,012, wherein reaction mother liquor is taken out of a reactor and a precipitation method disclosed in U.S. Pat. Nos. 2,618,556 and 2,735,841 wherein desalting is carried out using a coagulant. The ultra filtration method is more preferable in view of less photographic property fluctuation.

Arbitrary form of silver halide grains of the present invention can be used. One preferred example is a cubic having {100} as a crystal surface. In addition, by the use of technologies disclosed in U.S. Pat. Nos. 4,183,756 and 4,225,666, Japanese Patent O.P.I. Publication No. 26589/1980, Japanese Patent Publication No. 42737/1980 and The Journal of Photographic Science (J. Photogr. Sci.) 21 and 39 (1973), octahedral, tetradecahedral and dodecahedral grains may be prepared and used. In addition, grains having twinned surface may be used. The silver halide grains of the present invention may employ grains composed of a single form and may also employ grains wherein various forms of grains are mixed.

In the invention a chalcogen sensitizer can be used as a chemical sensitizer. The chalcogen sensitizer includes sulfur sensitizers, selenium sensitizers and tellurium sensitizers. Among them, sulfur sensitizers and selenium sensitizers are preferable. As sulfur sensitizers, conventional ones such as thiosulfate, allylthiocarbamide, thiourea, allyliso-thiacyanate, cystine, p-toluenethiosulfonate salt and rhodanine are cited. Besides them, sulfur sensitizers can be also used which are disclosed in U.S. Pat. Nos. 1,574,944, 2,410,689, 2,287,947, 2,728,668, 3,501,313 and 3,656,955, German Patent Publication (OLS) No. 1,422,869, Japanese Patent O.P.I. Publication Nos. 56-24937/1981 and 55-45016/1980. The addition amount of the sulfur sensitizer is different and varied over a wide range depending upon various conditions such as pH, temperature and silver halide grain size. However, the amount is preferably $10^{-7}$ to $10^{-1}$ mol per mol of silver halide.

The selenium sensitizer can be used instead of a sulfur sensitizer. The selenium sensitizer includes aliphatic isoselenocyanates such as allylisoselenocyanate, selenoureas, selenoketones, selenoamides, selenocarboxylates or esters, selenophosphates, and selenides such as diethylselenide and diethyldiselenide. The typical compounds thereof are disclosed in U.S. Pat. Nos. 1,574,944, 1,602,592 and 1,623,499. Further, a reducing sensitizer can be used in combination. The reducing sensitizer is not specifically limited, but includes stannous chloride, thiourea dioxide, hydrazines and polyamines. Further, a noble metal compound such as a platinum compound or a palladium compound can be also used.

The gold sensitizer has +1 or +3 of oxidation number, and other gold compounds can be used. The typical example includes chloroaurates, potassium chloroaurate, auric trichloride, potassium auric thiocyanate, potassium iodoaurate, tetracyanoauric acid, ammonium aurothiocyanate, pyridyltrichloro gold, auric sulfide and auric selenide.

The addition amount of a gold sensitizer may be different depending on various conditions, but genarally $10^{-8}$ to $10^{-1}$ mol of mol of silver halide, and preferably $10^{-7}$ to $10^{-2}$ mol of mol of silver halide. The gold sensitizer may be added during silver halide grain formation, during phisical ripening, during chemical sensitization, or after chemical sensitization.

In the invention a sensitizing dye may be added in any process of manufacturing a silver halide emulsion which includes a process selected from processes before or during silver halide grain formation, from after silver halide grain formation to beginning of chemical sensitization, at beginning of chemical sensitization, during chemical sensitization, and from after chemical sensitization to emulsion coating. The sensitizing dye is preferably added in a process during silver halide grain formation, from after silver halide grain formation to beginning of chemical sensitization, at beginning of chemical sensitization, during chemical sensitization or from after chemical sensitization to emulsion coating. The sensitizing dye is more preferably added after silver halide grain formation at a temperature lower than the chemical sensitizing temperature (temperature at addition of a chemical sensitizer) which gives highly linear line at from medium density portions to shoulder of a photographic characteristic curve, that is, excellent gradation and high Dmax.

An anti-fogging agent or stabilizing agent well known in the art can be added to the silver halide emulsion in the invention during and/or after chemical sensitization, or prior to emulsion coating.

As a coupler used in the silver halide light sensitive material in the invention is used any compound capable of forming a coupling product having a maximum spectral sensitivity wavelength in a wavelength region longer than 340 nm on coupling reaction with an oxidation product of a color developing agent. The typical coupler includes a yellow coupler having a maximum spectral sensitivity wavelength in a range of 350 to 500 nm, a magenta coupler having a maximum spectral sensitivity wavelength in a range of 500 to 600 nm, and a cyan coupler having a maximum spectral sensitivity wavelength in a range of 600 to 750 nm.

The yellow coupler preferably used in the light sensitive material in the invention includes a coupler represented by formula (Y-I) described on page 8, and exemplified compounds represented by YC-1 through YC-9 described on pages 9-11 of Japanese Patent Application No. 2-234208/1990. Of these YC-8 and YC-9 on page 11 are preferable in view of forming an excellent yellow dye.

The magenta coupler preferably used in the light sensitive material in the invention includes a coupler represented by formula (M-I) or (M-II) described on page 12, and exemplified compounds represented by MC-1 through MC-11 described on pages 13–16 of Japanese Patent Application No. 2-234208/1990. Of these MC-8 through MC-11 on pages 15 and 16 are preferable in view of excellent color reproduction over blue or violet to red and excellent image reproduction in detail.

The cyan coupler preferably used in the light sensitive material in the invention includes a coupler represented by formula (C-I) or (C-II) described on page 17, and exemplified compounds represented by CC-1 through CC-9 described on pages 18-21 of Japanese Patent Application No. 2-234208/1990.

When a coupler is added to a silver halide photographic light sensitive material in the invention using an oil in water type emulsifying method, the coupler is usually dissolved in a water-insoluble, high boiling point organic solvent having a boiling point of 150° C. or more, a low boiling point and/or water soluble organic solvent being optionally added, the solution is added to a hydrophilic binder solution such as a gelatin solution, and then emulsified using a surfactant. The emulsifying means includes a stirrer, a homogenizer, a colloid mill, a flow-jet mixer and a ultrasonic emulsifier. The process removing a low boiling point organic solvent may be added during or after the emulsification. As a high boiling point organic solvent used for dissolving and emulsifying a coupler, phthalates such as dioctyl phthalate or phosphates such as tricresyl phosphate are preferable.

For the purpose of shifting an absorption wavelength of a color dye compound (d-11) described on pages 33 and compound (A'-1) described on pages 35 of Japanese Patent O.P.I. Publication No. 4-114152/1992 can be used. Besides the compounds, a fluorescent dye releasing compound disclosed in U.S. Pat. No. 4,774,187 are used.

The coating amount of the coupler is not specifically limited so long as its sufficient concentration is given, but preferably $1\times10^{-3}$ to 5 mol per mol of silver, and more preferably $1\times10^{-2}$ to 1 mol per mol of silver. The silver halide crystal grain used in the invention may have any form such as a cubic form, an octahedral form, a tetradecahedral form comprised of a mixture of (100) and (111) planes, a form having (110) planes, a spherical form or a tabular form. Suitably usable silver halide grains are ones having an average grain diameter of 0.05 to 3 μm. The silver halide emulsion used in the invention may be either a monodisperse emulsion comprising grains having uniform grain diameters or uniform crystal habits or a polydisperse emulsion comprising grains whose grain diameters or crystals habits are not uniform. In the invention, the monodisperse silver halide emulsion is one in which the weight of the silver halide grains having a grain diameter within the limit of its average diameter rm±20% accounts for preferably not less than 60%, more preferably not less than 70%, and most preferably not less than 80% of the total weight of the whole silver halide grains thereof. The average grain diameter rm herein is defined as the grain diameter ri in the case where the product of frequency ni of the grain having a grain diameter ri and $ri^3$, i.e., nix $ri^3$, comes to the maximum (round to three decimal places), wherein the grain diameter, in the case of a spherical silver halide grain, is the diameter itself, while in the case of a non spherical grain, is the diameter of a circular image equivalent in the area to the projection image of the grain. The grain diameter can be obtained by a method in which the grain is electron microphotographically 10,000-fold to 50,000-fold enlarged, and the diameter of the enlarged grain image on its photo print or the area of the projection grain image enlarged likewise is .actually measured. (The number of grains for measurement shall be 1000 or more at random.)

The most preferred highly monodisperse emulsion is of silver halide grains having a grain diameter distribution broadness of not more than 20%, the distribution broadness being defined by Grain diameters standard deviation/average diameter× 100=distribution broadness (%)

wherein the above average grain diameter and the grain diameter standard deviation are to be found from the earlier defined ri.

For the silver halide photographic light-sensitive materials of the present invention, it is advantageous to use gelatin as a binder. In addition, other gelatins, gelatin derivatives, graft polymers between gelatin and other polymers, proteins other than gelatin, sugar derivatives, cellulose derivatives and hydrophilic colloid such as synthetic hydrophilic polymers including homopolymers or copolymers can also be used if necessary.

As a reflective support in the present invention, any support is used, and papers laminated with white-pigment-containing polyethylene, baryta papers, vinylchloride sheet, polypropylene containing a white pigment and a polyethylenephthalate support can be used. Of them, supports laminated with polyorefin resin layer containing white pigments are preferable.

As white pigments to be used for the reflective support in the present invention, inorganic and/or organic white pigments can be used. The preferred are inorganic white pigments. For example, sulfate of alkaline earth metals such as barium sulfate, carbonate salts of alkaline earth metals such as calcium carbonate, silicas such as fine silicate and synthetic silicate, calcium silicate, alumina, alumina hydrate, titanium oxide, zinc oxide, talc and clay are cited. The preferred white pigments are barium sulfate and titanium oxide.

The amount of white pigment contained in the water-repellent resin layer on the surface of the reflective support in the present invention is preferable to be not less than 10% by weight, more preferable to be not less than 13% by weight and especially preferable to be not less than 15% by weight in terms of the content amount in the water-proof resin layer. The method of adding white pigment in a high concentration is preferably a method employing an electron beam hardenable resin as a water-repellent resin, and more preferably a method in which white pigment is added to a hydrophilic colloid layer coated on a support. The degree of dispersion of white pigment in the water repellent resin layer on a paper support of the present invention can be measured by means of a method described in Japanese Patent O.P.I. Publication No. 28640/1990. When measured by means of this method, the degree of dispersion of white pigment is preferable to be not more than 0.20, more preferable to be not more than 0.15 and especially more preferable to be not more than 0.10 in terms of coefficient of variation described in the aforesaid specification.

After the surface of the support is provided with corona discharge, UV ray irradiation and firing treatment if necessary, the silver halide photographic light sensitive material in the invention may be coated directly or through subbing layers (one or two or more subbing layer in order to improve adhesiveness, anti-static property stability in sizing, anti-abrasion property, stiffness, anti-halation property, abrasion property and/or other properties of the surface of the support.)

When a light-sensitive material using silver halide emulsions is coated, a thickener may be used. As coating methods, an extrusion coating method and a curtain coating method is especially advantageous because they can coat 2 or more layers concurrently.

The color developing agent used in color developer in the present invention includes a conventional color developing agent which is widely used in various color photographic processes.

In the invention the light sensitive material is color developed with color developer, and then processed with a processing solution having a bleaching ability (so-called bleach-fixer). The bleaching agent in the bleaching process includes a metal complex of an organic acid.

EXAMPLE

Examples of the invention are shown below, but embodiments of the invention are not limited to these examples.

Example 1

(Solution A) and (Solution B) both stated below were added simultaneously to 1 l of 2% gelatin aqueous solution kept to 40° C. spending 30 minutes while they were regulated to pAg 6.5 and pH 3.0, and further, (Solution C) and (Solution D) both stated below were added simultaneously thereto spending 120 minutes while they were regulated to pAg 7.3 and pH 5.5, In this case, the method in Japanese Patent O.P.I. Publication No. 45437/1984 was used for regulation of pAg and sulfuric acid or sodium hydroxide aqueous solution was used for regulation of pH.

| | |
|---|---|
| (Solution A) | |
| Sodium chloride | 3.42 g |
| Potassium bromide | 0.03 g |
| Water was added to make | 200 ml. |
| (Solution B) | |
| Silver nitrate | 10 g |
| Water was added to make | 200 ml. |
| (Solution C) | |
| Sodium chloride | 78.7 g |
| Potassium bromide | 0.157 g |
| Water was added to make | 446 ml. |
| (Solution D) | |
| Silver nitrate | 190 g |
| Water was added to make | 380 ml. |

After completion of adding, 10% aqueous solution of exemplified compound (Z-8) of the invention and magnesium sulfate 30% aqueous solution were used for desalting. After that, they were mixed with gelatin aqueous solution to obtain a monodispersed cubic grained emulsion (Em—GA) having an average particle size of 0.04 μm, coefficient of variation of 0.07, and silver chloride content of 99.5 mol %.

(Em—GB) was obtained in the same manner as that for manufacturing Em—GA except that desalting was performed in the ultrafiltration method described in Japanese Patent Publication No. 501776/1981.

Compounds shown in Table 1 were added to Em—GA and Em—GB, then, compounds described below were used for chemical ripening at 60° C. for 120 minutes for obtaining a green-sensitive halogenated emulsion.

| | |
|---|---|
| Sodium thiosulfate | 1.5 mg/mol AgX |
| Stabilizing agent (STAB-1) (same as Example 3 described later) | $6 \times 10^{-4}$ mol/mol AgX |
| Stabilizing dye (GS-1) (same as Example 3 described later) | $3 \times 10^{-4}$ mol/mol AgX |

The emulsion thus obtained was divided into two portions, and immediately after that, one portion thereof and magenta coupler dissolved in dibutylphthalate (M-I) (same as magenta coupler in Example 3 described later) were added in quantity of 0.4 mol per mol of silver halide, and then sodium dodecylbenzenesulfonate was added thereto as a coating aid. The emulsion was coated on a paper support having thereon laminated polyethylene containing titanium oxide at the rate showing silver coating weight of 0.35 g/m$^2$ and a gelatin amount of 3.0 g/m$^2$.

Further, a protective layer was provided thereon by coating gelatin at the rate of 4.0 g/m$^2$, so that the samples were prepared.

The other portion of the divided emulsion was put in a beaker made of stainless steel which was covered by a black vinyl sheet to be shielded against light, and it was further sealed. It was kept in a refrigerator at 7° C. for 5 months. After that, it was coated under the same conditions as those for the foregoing, and samples were prepared.

The samples thus obtained were subjected to evaluation of each performance conducted through the following methods.

Sensitivity

Each sample was subjected to wedge exposure for 0.1 seconds using Sensitometer KS-7 (made by Konica Corp.), and then was subjected to color development processing conducted in accordance with the following processing steps. After that, Optical Densitometer PDA-65 (made by Konica Corp.) was used for measurement of density of the sample, and a logarithm of an inverse number of an exposure amount needed for obtaining density that is higher than fog density by 0.8 was used to represent sensitivity of the sample which is shown as a relative value to the sensitivity of Sample No. 101 or 201 representing an immediately-coated sample whose sensitivity is 100.

Fog

In the same manner as in the sensitivity evaluation, each sample obtained was subjected to color development processing conducted in accordance with processing steps without being exposed to light, and then X-Rite 310 (made by X-Rite Co. ) was used for density measurement for showing fog density.

The above obtained samples were processed according to the following processing conditions, and the results are shown in Table 1.

| Processing step | Temperature | Time |
|---|---|---|
| Color developing | 35.0 ± 0.3° C. | 45 seconds |
| Bleach-fixing | 35.0 ± 0.5° C. | 45 seconds |
| Stabilizing | 30–34° C. | 90 seconds |
| Drying | 60–80° C. | 60 seconds |

-continued

| | |
|---|---|
| Potassium bromide | 0.02 g |
| Potassium chloride | 2 g |
| Potassium sulfite | 0.3 g |
| 1-hydroxyethylidene-1,1-diphosphate | 1.0 g |
| Ethylenediamine tetraacetate | 1.0 g |
| Disodium catechol-3.5-diphosphate | 1.0 g |
| N-ethyl-N-β-methanesulfonamidoethyl-3-methyl-4-aminoaniline sulfate | 4.5 g |
| Fluorescent brightening agent (4,4'-diaminostylbenesulfonate derivative) | 1.0 g |
| Potassium carbonate | 27 g |
| Water was added to make 1 l in total and pH was regulated to 10.10. | |
| (Bleach-fixer) | |
| Ethylenediamine tetraacetate ferric ammonium dehydrate | 60 g |
| Ethylenediamine tetraacetate | 3 g |
| Ammonium thiosulfate (70% aqueous solution) | 100 ml |
| Ammonium sulfite (40% aqueous solution) | 27.5 ml |
| Water was added to make 1 l in total, and pH was regulated to potassium carbonate or glacial acetic acid to 5.7. | |
| (Stabilizer) | |
| 5-chloro-2-methyl-4-isothiazoline-3-on | 1.0 g |
| Ethylene glycol | 1.0 g |
| 1-hydroxyethylidene 1,1-diphosphate | 2.0 g |
| Ethylenediamine tetraacetate | 1.0 g |
| Ammonium hydroxide (20% aqueous solution) | 3.0 g |
| Fluorescent brightening agent (4,4'-diaminostylbenesulfonate derivative) | 1.5 g |
| Water was added to make 1 l in total, and pH was regulated to 7.0 with sulfuric acid or potassium hydroxide. | |

TABLE 1

| Sample No. | Emulsion | Compound in the Invention | Addition Amount (g/molAg) | Sensitivity Fresh | Sensitivity After 5 month Storage at 5° C. | Fog Fresh | Fog After 5 month Storage at 5° C. | Remarks |
|---|---|---|---|---|---|---|---|---|
| 101 | Em-GA | — | — | 100 | 90 | 0.03 | 0.20 | Comparative |
| 102 | Em-GA | Z-0** | 2.3 | 101 | 93 | 0.03 | 0.19 | Comparative |
| 103 | Em-GA | Z-1 | 2.3 | 120 | 118 | 0.02 | 0.03 | Invention |
| 104 | Em-GA | Z-1 | 5.0 | 131 | 129 | 0.03 | 0.04 | Invention |
| 105 | Em-GA | Z-8 | 2.3 | 122 | 121 | 0.02 | 0.02 | Invention |
| 106 | Em-GA | Z-8 | 5.0 | 136 | 135 | 0.03 | 0.03 | Invention |
| 107 | Em-GA | Z-9 | 5.0 | 134 | 133 | 0.02 | 0.02 | Invention |
| 108 | Em-GB | — | — | 95 | 86 | 0.02 | 0.50 | Comparative |
| 109 | Em-GB | Z-0** | 2.3 | 98 | 91 | 0.02 | 0.40 | Comparative |
| 110 | Em-GB | Z-1 | 2.3 | 115 | 114 | 0.02 | 0.03 | Invention |
| 111 | Em-GB | Z-1 | 5.0 | 127 | 126 | 0.03 | 0.03 | Invention |
| 112 | Em-GB | Z-8 | 2.3 | 118 | 118 | 0.02 | 0.02 | Invention |
| 113 | Em-GB | Z-8 | 5.0 | 132 | 132 | 0.02 | 0.02 | Invention |
| 114 | Em-GB | Z-9 | 5.0 | 130 | 130 | 0.02 | 0.02 | Invention |
| 115* | Em-GB | Z-9 | 5.0 | 120 | 117 | 0.02 | 0.05 | Invention |

*The silver halide grains having coefficient of variation of 0.25 in the grain size distribution were used. The grains of the other samples had coefficient of variation of 0.07 in the grain size distribution.
**Compound Z-0 was used as a comparative compound.

(Color developing solution)

| | |
|---|---|
| Pure water | 800 ml |
| Triethanolamine | 10 g |
| N,N-diethylhydroxylamine | 5 g |

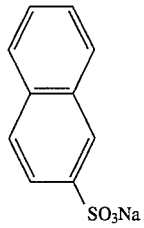

As is apparent from Table 1, samples prepared by adding the compound in the invention during chemical sensitization have higher sensitivity and less fluctuation of photographic properties after storage of the emulsion.

Example 2

Five emulsions were prepared in the same manner as in Example 1 and coated immediately after the preparation in the same manner as in Example 1 to obtain light sensitive material samples. The resulting samples were evaluated for sensitivity in the same manner as in Example 1, and further evaluated for production reliability between production lots. The results are shown in Table 2.

TABLE 2

| Emulsion | Sensitivity of Fresh Emulsion | | | | | |
|---|---|---|---|---|---|---|
| Preparation Conditions | Preparation 1 | Preparation 2 | Preparation 3 | Preparation 4 | Preparation 5 | Remarks |
| Same Condition as 101 | 100 | 90 | 95 | 108 | 103 | Comparative |
| Same Condition as 102 | 101 | 108 | 103 | 91 | 96 | Comparative |
| Same Condition as 103 | 120 | 122 | 119 | 119 | 121 | Invention |
| Same Condition as 104 | 131 | 130 | 132 | 129 | 131 | Invention |
| Same Condition as 105 | 122 | 121 | 122 | 121 | 123 | Invention |
| Same Condition as 106 | 136 | 136 | 135 | 135 | 137 | Invention |
| Same Condition as 107 | 134 | 133 | 134 | 132 | 133 | Invention |
| Same Condition as 108 | 95 | 99 | 102 | 95 | 90 | Comparative |
| Same Condition as 109 | 98 | 104 | 101 | 92 | 98 | Comparative |
| Same Condition as 110 | 115 | 115 | 114 | 117 | 116 | Invention |
| Same Condition as 111 | 127 | 129 | 128 | 126 | 128 | Invention |
| Same Condition as 112 | 118 | 118 | 117 | 118 | 117 | Invention |
| Same Condition as 113 | 132 | 133 | 132 | 132 | 132 | Invention |
| Same Condition as 114 | 130 | 129 | 129 | 130 | 130 | Invention |
| Same Condition as 115 | 120 | 118 | 116 | 116 | 119 | Invention |

As is apparent from Table 2, samples prepared by adding the compound in the invention during chemical sensitization have less fluctuation between production lots and give stable sensitivity. Further, the emulsions employing a ultra filtration method are especially excellent.

Example 3

In the same manner as that for Em-GA in Example 1 except that a period of time for adding (Solution A) and (Solution B) and that for adding (Solution C) and (Solution D) were changed, a monodispersed cubic grained emulsion Em-BA having an average particle size of 0.85 μm, coefficient of variation of 0.07 and silver chloride content of 99.9 mol % was obtained. (Em-BB) was obtained in the same manner as that for Em-BA except that desairing was conducted through an ultrafiltration method similarly to Example 1.

Similarly to the foregoing, in the same manner as that for Em-GA in Example 1 except that a period of time for adding (Solution A) and (Solution B) and that for adding (Solution C) and (Solution D) were changed, a monodispersed cubic grained emulsion Em-RA having an average particle size of 0.5 μm, coefficient of variation of 0.08 and silver halide content of 99.9 mol % was obtained. (Em-RB) was obtained in the same manner as that for Em-RA except that desalting was conducted through an ultrafiltration method.

Compounds of the invention shown in Table 5 were added to Em-BA and Em-BB, and then the following compounds were used for conducting chemical ripening at 50° C. for 90 minutes to obtain a blue-sensitive halogenated emulsion.

| | |
|---|---|
| Sodium thiosulfate | 0.8 mg/mol AgX |
| Stabilizing agent (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Compounds of the invention shown in Table 5 were added to Em-RA and Em-RB, and then the following compounds were used for conducting chemical ripening at 60° C. for 90 minutes to obtain a red-sensitive halogenated emulsion.

| | |
|---|---|
| Sodium thiosulfate | 1.8 mg/mol AgX |
| Stabilizing agent (STAB-1) | $6 \times 10^{-4}$ mol/mol AgX |
| Sensitizing dye (RS-1) | $1 \times 10^{-4}$ mol/mol AgX |

The emulsion thus obtained was divided into two portions similarly to Example 1, and immediately after that, one of the divided portions was coated on a paper support having thereon laminated polyethylene containing titanium oxide to form each layer of the structure shown below, and a multi-layer color light-sensitive material was prepared. Coating solutions were prepared in the manner described below.

As a hardener, (H-1) and (H-2) were added. As a coating aid, surfactants (SU-2) and (SU-3) were added and surface tension was adjusted. To each layer, F-1 was added so that total amount may show 0.04 g/m$^2$.

The other portion of the divided emulsion was put in a beaker made of stainless steel which was covered by a black vinyl sheet to be shielded against light, and it was further sealed. It was kept in a refrigerator at 7° C. for 5 months. After that, it was coated under the same conditions as those for the foregoing, and samples were prepared.

TABLE 3

| Layer | Structure | Added amount (g/m$^2$) |
|---|---|---|
| 7th layer (Protective layer) | Gelatin | 1.00 |
| | DIDP | 0.005 |
| | Silicone dioxide | 0.003 |
| 6th layer (UV absorbing layer) | Gelatin | 0.40 |
| | AI-2 | 0.01 |
| | UV absorber (UV-1) | 0.12 |
| | UV absorber (UV-2) | 0.04 |
| | UV absorber (UV-3) | 0.16 |
| | Anti-stain agent (HQ-5) | 0.04 |
| | PVP | 0.03 |
| 5th layer (Red sensitive layer) | Gelatin | 1.30 |
| | Red sensitive silver bromochloride emulsion | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-1) | 0.004 |
| | DOP | 0.34 |
| 4th layer (UV absorbing layer) | Gelatin | 0.94 |
| | UV absorber (UV-1) | 0.28 |
| | UV absorber (UV-2) | 0.09 |
| | UV abosrber (UV-3) | 0.38 |
| | AI-2 | 0.02 |
| | Anti-stain agent (HQ-3) | 0.10 |

TABLE 4

| Layer | Structure | Added Amount (g/m$^2$) |
|---|---|---|
| 3rd layer (Green snesitive layer) | Gelatin | 1.30 |
| | AI-1 | 0.01 |
| | Green sensitive silver bromochloride emulsion | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.06 |
| | Fluorenscent brightening agent (W-1) | 0.10 |
| 1st layer (Blue sensitive layer) | Gelatin | 1.20 |
| | Blue sensitive silver bromochloride emulsion | 0.26 |
| | Yellow coupler (Y-1) | 0.70 |
| | Dye image stabilizer (ST-1) | 0.10 |
| | Dye image stabilizer (ST-2) | 0.10 |
| | Anti-stain agent (HQ-1) | 0.01 |
| | Dye image stabilizer (ST-5) | 0.10 |
| | Compound A | 0.15 |
| | DBP | 0.15 |
| Support | Paper laminated with polyetylene (containing minute colorant) | |

The added amount of silver halide emulsions is illustrated in terms of silver.

SU-1:Sodium tri-i-propylnaphthalenesulfonate

SU-2: Sodiumsulfo di-2-ethylhexyl succinate

SU-3: Sodiumsulfo di-2,2,3,3,4,4-octafluoropentyl | succinate

DBP: Dibutylphthalate

DNP: Dinonylphthalate

DOP; Dioctylphthalate

DIDP: Di-i=decylphthalate

PVP: Polyvinylpyrrolidone

H-1: Tetrakis(vinylsulfonylmethyl) metahne

H-2: Sodium 2,4-dichloro-6-hydrory-s-triazine

Compound A: p-t-Octylphenol

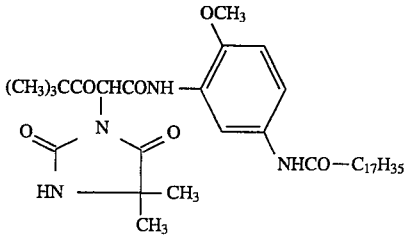

Y-1

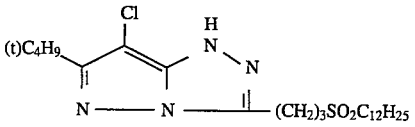

M-1

-continued
C-1
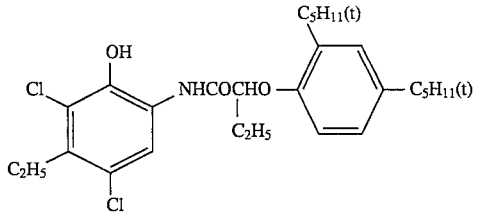
C-2
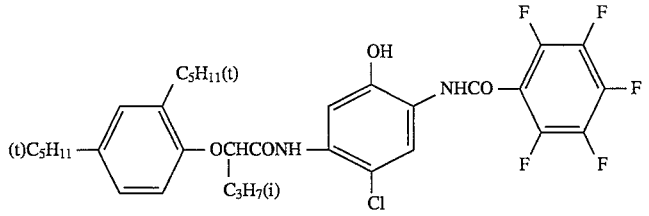
ST-1
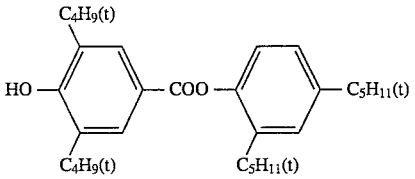
ST-2
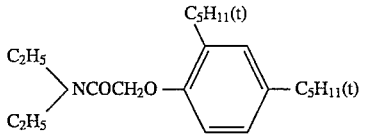
ST-3
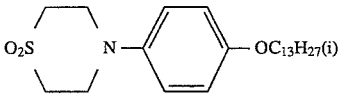
ST-4
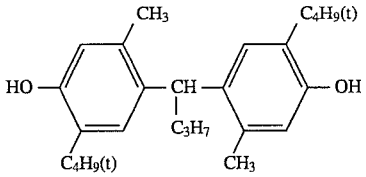
ST-5
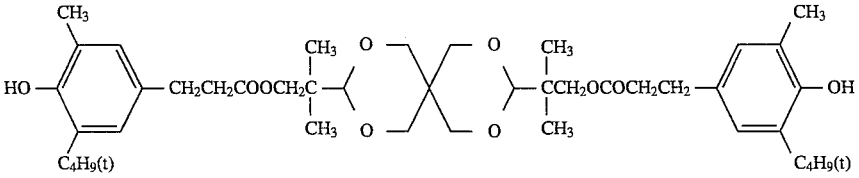
UV-1
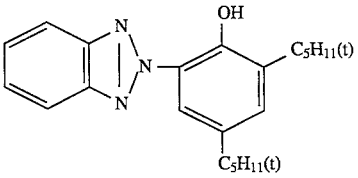
UV-2
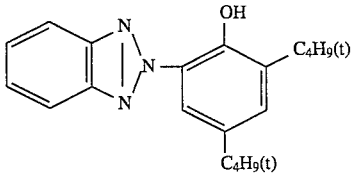
UV-3
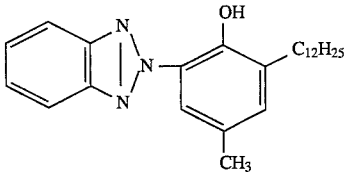
HQ-1
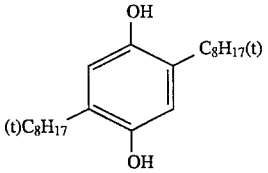
HQ-2
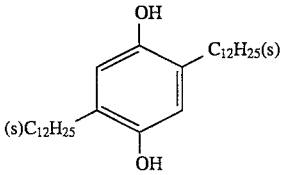
HQ-3
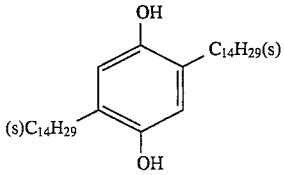

-continued
HQ-4
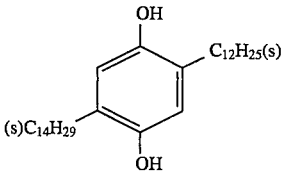
HQ-5
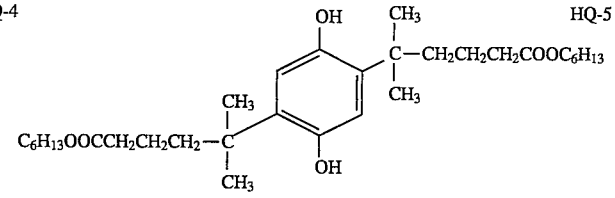
AI-1
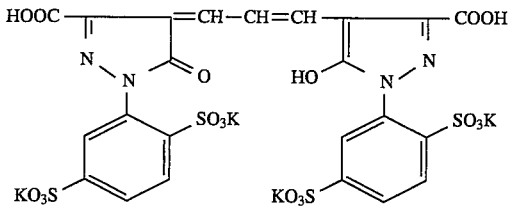
AI-2
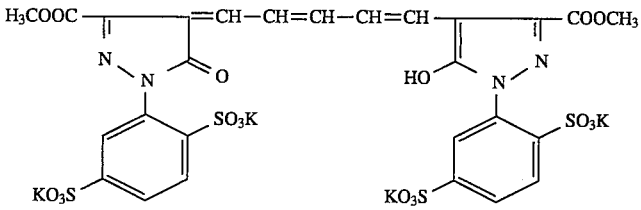
AI-3
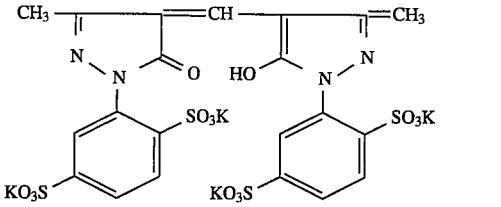
W-1
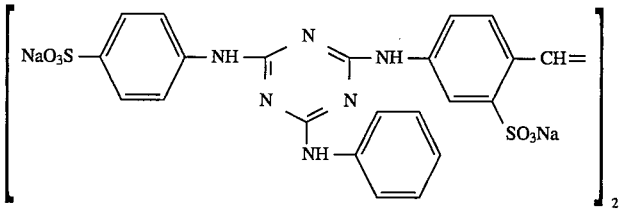
F-1
A mixture of
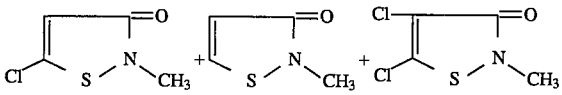
(50%) (46%) (4%) mol ratio
BS-1
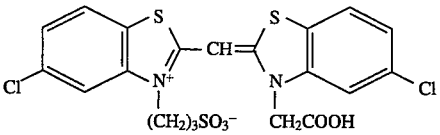
BS-2
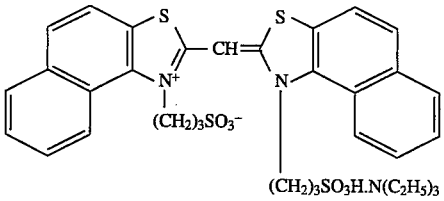
GS-1
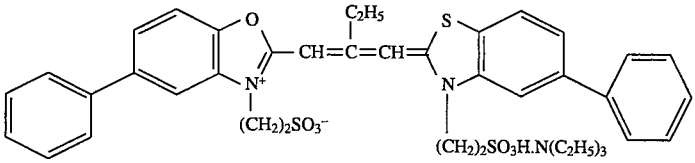

-continued

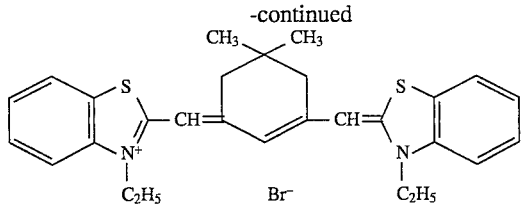

RS-1

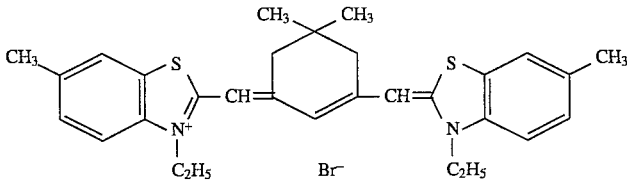

RS-2

Samples obtained were subjected to the processing in accordance with processing steps in the same manner as that in Example 1 to be evaluated. Contents of the sample are shown in Table 5, and the results of the evaluation are shown in Table 6.

TABLE 5

| | | | | Compounds in the invention (g/mol Ag) | | |
|---|---|---|---|---|---|---|
| Sample No. | Blue-sensitive layer | Green-sensitive layer | Red-sensitive layer | Blue-sensitive layer | Green-sensitive layer | Red-sensitive layer |
| 201 | Em-BA | Em-GA | Em-RA | — | — | — |
| 202 | Em-BA | Em-GA | Em-RA | Z-0 0.8 | Z-0 2.3 | Z-0 3.0 |
| 203 | Em-BA | Em-GA | Em-RA | Z-1 0.8 | Z-1 2.3 | Z-1 3.0 |
| 204 | Em-BA | Em-GA | Em-RA | Z-1 2.5 | Z-1 5.0 | Z-1 5.5 |
| 205 | Em-BA | Em-GA | Em-RA | Z-8 0.8 | Z-8 2.3 | Z-8 3.0 |
| 206 | Em-BA | Em-GA | Em-RA | Z-8 2.5 | Z-8 5.0 | Z-8 5.5 |
| 207 | Em-BB | Em-GB | Em-RB | — | — | — |
| 208 | Em-BB | Em-GB | Em-RB | Z-0 0.8 | Z-0 2.3 | Z-0 3.0 |
| 209 | Em-BB | Em-GB | Em-RB | Z-1 0.8 | Z-1 2.3 | Z-1 3.0 |
| 210 | Em-BB | Em-GB | Em-RB | Z-1 2.5 | Z-1 5.0 | Z-1 5.5 |
| 211 | Em-BB | Em-GB | Em-RB | Z-8 0.8 | Z-8 2.3 | Z-8 3.0 |
| 212 | Em-BB | Em-GB | Em-RB | Z-8 2.5 | Z-8 5.0 | Z-8 5.5 |

TABLE 6

| | Sensitivity | | | | | | Fog | | | | | | |
|---|---|---|---|---|---|---|---|---|---|---|---|---|---|
| | BSL | | GSL | | RSL | | BSL | | GSL | | RSL | | |
| Sample No. | Fresh | After 5 month Storage at 7° C. | Fresh | After 5 month Storage at 7° C. | Fresh | After 5 month Storage at 7° C. | Fresh | After 5 month Storage at 7° C. | Fresh | After 5 month Storage at 7° C. | Fresh | After 5 month Storage at 7° C. | Remarks |
| 201 | 100 | 92 | 100 | 90 | 100 | 85 | 0.05 | 0.40 | 0.03 | 0.20 | 0.03 | 0.25 | Comp. |
| 202 | 100 | 94 | 101 | 93 | 98 | 87 | 0.05 | 0.40 | 0.03 | 0.19 | 0.03 | 0.22 | Comp. |
| 203 | 118 | 116 | 120 | 118 | 116 | 114 | 0.05 | 0.06 | 0.02 | 0.03 | 0.02 | 0.03 | Inv. |
| 204 | 130 | 128 | 131 | 129 | 128 | 126 | 0.05 | 0.06 | 0.03 | 0.04 | 0.03 | 0.04 | Inv. |
| 205 | 119 | 118 | 122 | 121 | 117 | 116 | 0.05 | 0.06 | 0.02 | 0.02 | 0.03 | 0.03 | Inv. |
| 206 | 134 | 133 | 136 | 135 | 132 | 131 | 0.05 | 0.06 | 0.03 | 0.03 | 0.03 | 0.03 | Inv. |
| 207 | 92 | 86 | 95 | 86 | 90 | 80 | 0.04 | 0.60 | 0.02 | 0.50 | 0.03 | 0.46 | Comp. |
| 208 | 96 | 91 | 98 | 91 | 94 | 85 | 0.04 | 0.55 | 0.02 | 0.40 | 0.03 | 0.44 | Comp. |
| 209 | 113 | 112 | 115 | 114 | 111 | 110 | 0.05 | 0.06 | 0.02 | 0.03 | 0.02 | 0.02 | Inv. |
| 210 | 125 | 124 | 127 | 126 | 123 | 121 | 0.05 | 0.05 | 0.03 | 0.03 | 0.03 | 0.03 | Inv. |
| 211 | 116 | 116 | 118 | 118 | 114 | 114 | 0.04 | 0.04 | 0.02 | 0.02 | 0.02 | 0.02 | Inv. |
| 212 | 130 | 130 | 132 | 132 | 128 | 128 | 0.04 | 0.04 | 0.02 | 0.02 | 0.02 | 0.02 | Inv. |

Comp.: Comparative
Inv.: Invention
BSL; Blue sensitive layer
GSL: Green sensitive layer
RSL: Red sensitive layer As is apparent from Table 6, samples prepared by adding the compound in the invention during chemical sensitization have higher sensitivity and less fluctuation of photographic properties after storage of the emulsion. Further, the emulsions comprising a desalting process by a ultra filtration method are especially excellent.

What is claimed is:

1. A method of manufacturing a silver halide photographic emulsion comprising silver halide grains having a silver chloride content of not less than 95 mol %, the method comprising the steps of:

mixing a silver salt and a halide to form a silver halide emulsion; and chemically ripening the resulting silver halide emulsion, wherein a compound having two or more sulfonic acid or sulfonic acid salt groups in its molecule is added to the silver halide emulsion at the chemical ripening step, the compound being a condensation compound of napthalene sulfonic acid or naphthalene sulfonic acid salt with formaldehyde or a polymeric compound having a chemical structure represented by the following formula (1):

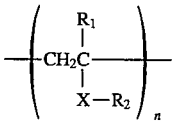

formula (1)

wherein $R_1$ represents a hydrogen atom or an alkyl group; X represents —OCO—, CONR'— or —$SO_2$NR'—, in which R' represents a hydrogen atom or an alkyl group; $R_2$ represents an alkyl, aryl or aralkyl group each having a sulfonic acid or sulfonic acid salt group; and n represents an integer of 2 or more.

2. The method of claim 1, wherein the silver halide grains have a silver chloride content of 98 to 99.9 mol %.

3. The method of claim 1, wherein the compound is added in an amount of not less than 0.1 g/mol of silver.

4. The method of claim 1, wherein the compound is added in an amount of 0.1 to 7.0 g/mol of silver.

5. The method of claim 1, wherein the compound is added in an amount of 0.2 to 6.0 g/mol of silver.

6. The method of claim 1, wherein the compound consists of three or more of a unit having a sulfonic acid group or a sulfonic acid salt group.

7. The method of claim 1, wherein the compound consists of five or more of a unit having a sulfonic acid group or a sulfonic acid salt group.

8. The method of claim 1, wherein coefficient of variation of the silver halide grain diameter distribution is not more than 0.20.

* * * * *